US006053077A

United States Patent [19]

Huang

[11] Patent Number: 6,053,077

[45] Date of Patent: Apr. 25, 2000

[54] RATCHET WRENCH HAVING TWO DRIVING STEMS

[76] Inventor: Yung Hsu Huang, No. 10, Lane 38, Li Der Street, Taiping City, Taichung Hsien, Taiwan

[21] Appl. No.: 09/131,683

[22] Filed: Aug. 10, 1998

[51] Int. Cl.[7] ..... B25B 13/46

[52] U.S. Cl. ..... 81/63.1; 81/59.1; 81/62

[58] Field of Search ..... 81/63.1, 60, 58, 81/59.1, 62; 7/108, 138

[56] References Cited

U.S. PATENT DOCUMENTS

| | | | |
|---|---|---|---|
| 2,803,980 | 8/1957 | Vogel | 81/62 |
| 4,497,227 | 2/1985 | Stasiek | 81/63.1 |
| 5,211,087 | 5/1993 | Thomason | 81/63.2 |

*Primary Examiner*—Timothy V. Eley
*Assistant Examiner*—Willie Berry, Jr.

[57] ABSTRACT

A ratchet wrench comprising a handle including a first end having a head formed thereon, a gear rotatably received in the head and including an upper portion having a first driving stem extended upward therefrom and including a lower portion having a second driving stem extended downward therefrom, a pair of pawls slidably received in the head for engaging with the gear, and means for selectively actuating the pawls to engage with the gear and to control and active direction of the gear and the driving stems, the head including a chamber formed therein and including a block received in the chamber of the head, the block including an opening for rotatably receiving the gear and including a slot tangent to the opening for slidably receiving the pawls.

7 Claims, 4 Drawing Sheets

RATCHET WRENCH HAVING TWO DRIVING STEMS

BACKGROUND OF THE INVENTION

1. Field of the Invention

The present invention relates to a wrench, and more particularly to a ratchet wrench having two driving stems of different sizes.

2. Description of the Prior Art

Typical wrenches comprise a driving shaft controlled by a ratchet mechanism and including a single driving stem for engaging with the fasteners or the tool extensions. However, The single driving stem includes a definite size and may be used for driving a fastener or a tool extension of the corresponding size only.

The present invention has arisen to mitigate and/or obviate the afore-described disadvantages of the conventional wrenches.

SUMMARY OF THE INVENTION

The primary objective of the present invention is to provide a ratchet wrench having two driving stems of different sizes for driving sockets, fasteners or tool extensions of different sizes.

In accordance with one aspect of the invention, there is provided a ratchet wrench comprising a handle including a first end having a head formed thereon, a gear rotatably received in the head and including an upper portion having a first driving stem extended upward therefrom and including a lower portion having a second driving stem extended downward therefrom, a pair of pawls slidably received in the head for engaging with the gear, and means for selectively actuating the pawls to engage with the gear and to control an active direction of the gear and the driving stems.

The driving stems include different sizes for engaging with and for driving sockets, fasteners and tool extensions of different sizes.

The head includes a chamber formed therein and includes a block received in the chamber, the block includes an opening for rotatably receiving the gear and includes a slot tangent to the opening for slidably receiving the pawls. The selectively actuating means includes a spring-biasing means for biasing the pawls to engage with the gear.

The selectively actuating means includes a first control ferrule rotatably secured to the head, the first control ferrule includes an actuator engaged into the slot of the block for actuating the pawls respectively when the actuator is rotated by the first control ferrule.

A positioning means is further provided for positioning the first control ferrule to the head and includes a plate secured to the block and having three depressions formed therein, the first control ferrule includes a spring-biased projection for selectively engaging with the depressions and for positioning the first control ferrule to the head.

The first control ferrule includes a cavity formed therein, the selectively actuating means further includes a second control ferrule rotatably secured to the head and having a bar engaged into the cavity and secured to the first control ferrule.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
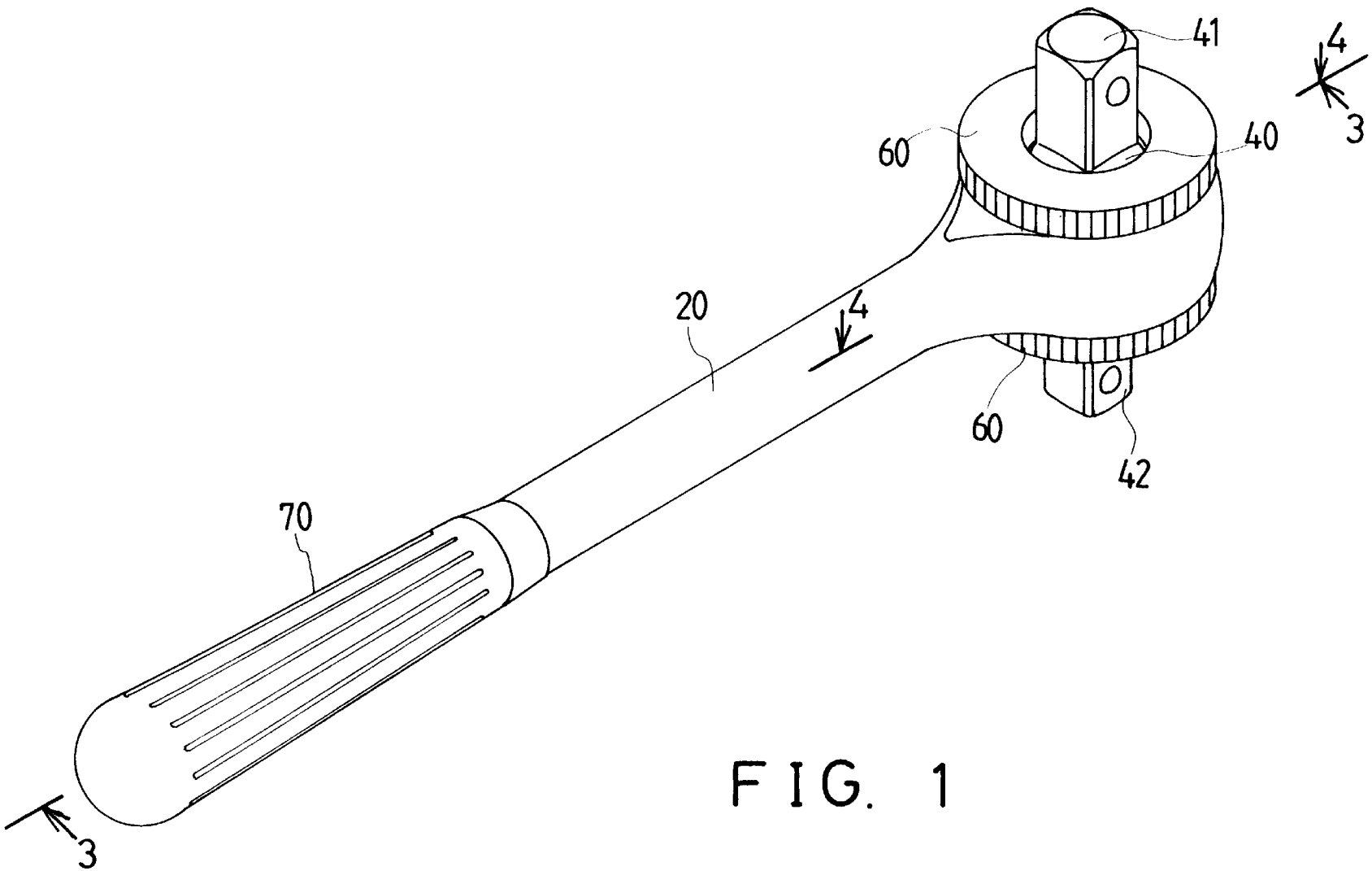
FIG. 1 is a perspective view of a ratchet wrench in accordance with the present invention.
Figure 2:
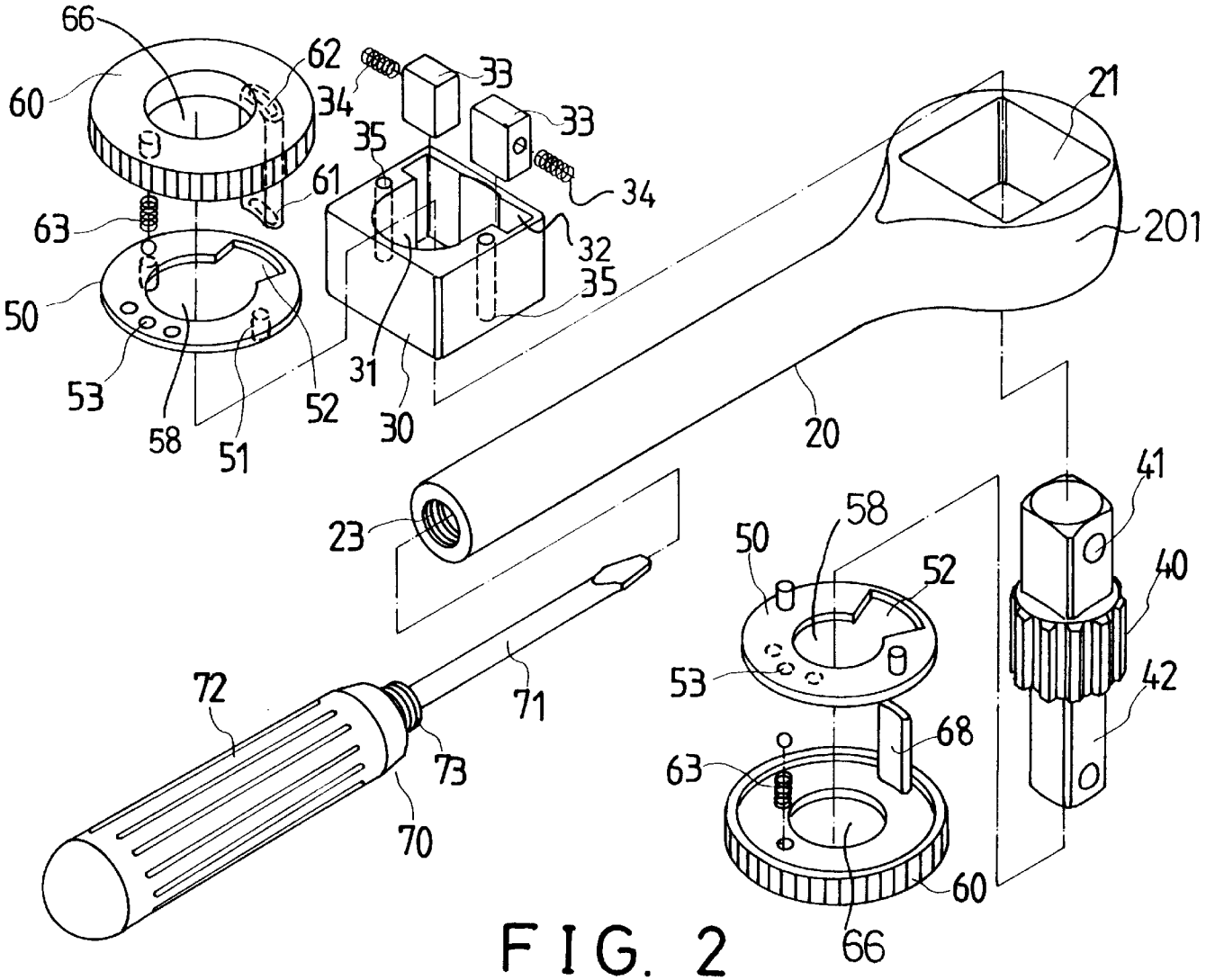
FIG. 2 is an exploded view of the ratchet wrench.
Figure 3:
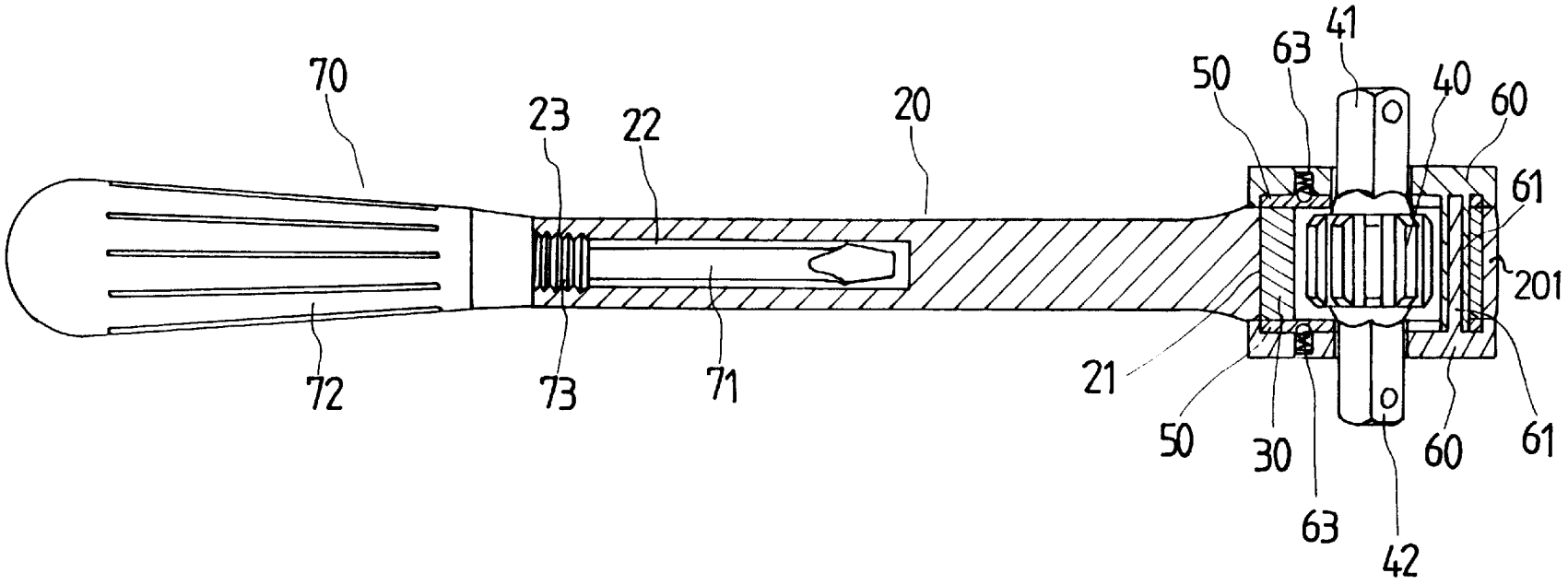
FIG. 3 is a cross sectional view taken along lines 3—3 of FIG. 1.

Referring to the drawings, and initially to FIGS. 1–4, a ratchet wrench in accordance with the present invention comprises a handle 20 including a head 201 formed on one end and including a screw hole 23 formed in the other end. The handle 20 may also include a bore 23 formed in the other end and an inner thread formed in the outer end portion of the bore 23 only. The head 201 includes a chamber 21 of non-circular cross section formed therein. A screw driver 70 includes a driving shaft 71 extended from a hand grip 72 and includes a bolt 73 provided between the driving shaft 71 and the hand grip 72 for engaging with the screw hole 23 of the handle 20 and for securing the screw driver 70 to the handle 20. The hand grip 72 of the screw driver 70 may extend the length of the handle 20.

Figure 6:
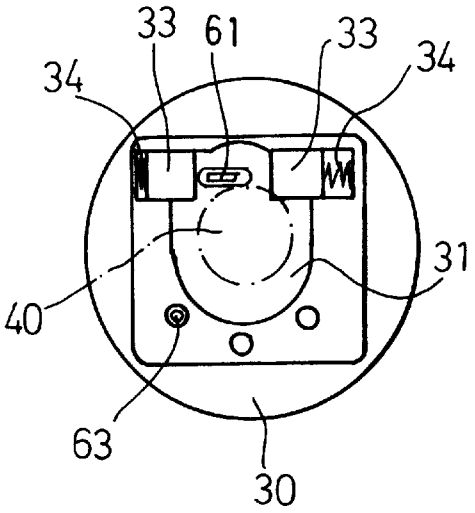
FIGS. 5 and 6 are schematic views similar to FIG. 4, illustrating the operation of the ratchet wrench.
Figure 5:
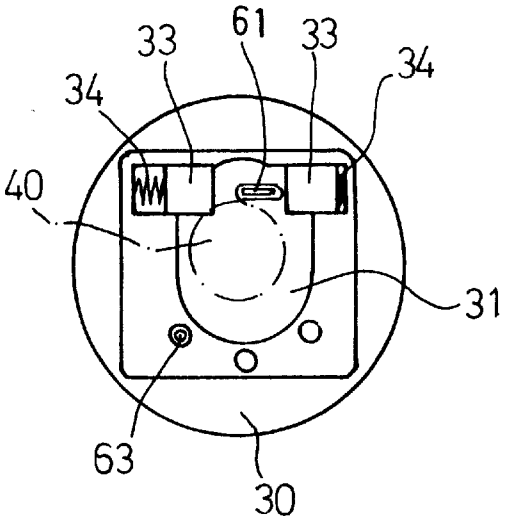
Figure 4:
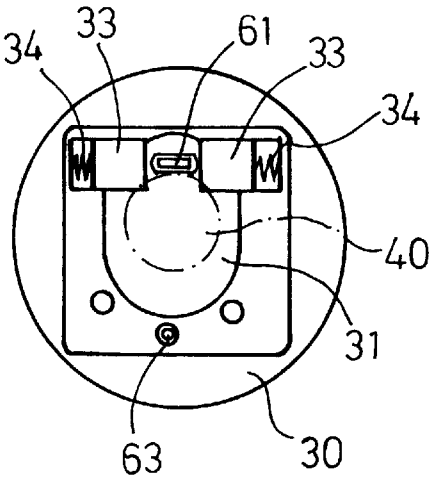
FIG. 4 is a schematic view taken along lines 4—4 of FIG. 1.

A block 30 is received in the chamber 21 and includes a non-circular cross section corresponding to that of the chamber 21 for allowing the block 30 to be solidly secured in the head 201 and to be rotated by the handle 20. The block 30 includes an opening 31 for rotatably receiving a gear 40 and includes a slot 32 tangent to the opening 31 and communicating with the opening 31 for slidably receiving two pawls 33 and two springs 34 which may bias the pawls 33 to engage with the gear 40 (FIGS. 4–6). The block 30 includes one or more punctures 35 formed therein. The gear 40 includes a driving stem 41 extended upward and another driving stem 42 extended downward therefrom. The driving stems 41, 42 include different sizes for driving sockets, fasteners or tool extensions of different sizes.

A plate 50 is engaged on top of the head 201 and includes one or more projections 51 engaged into and secured to the punctures 35 of the block 30 by such as a force-fitted engagement for securing the plate 50 to top of the head 201. Another plate 50 is engaged with the bottom of the head 201 and includes one or more projections 51 engaged into and secured to the punctures 35 of the block 30 by such as a force-fitted engagement for securing the plate 50 to bottom of the head 201. The plates 50 each includes three depressions 53 formed therein and each includes a hole 58 for rotatably receiving the respective driving stem 41, 42 and each includes a notch 52 communicating with the hole 58. A pair of control ferrules 60 are engaged with the plates 50 respectively and are engaged on top and the bottom of the head 201 respectively. A first of the control ferrules 60 includes an actuator 61 extended through the notches 52 of the plates 50 and extended through the slot 32 of the block 30 and located between the pawls 33 (FIG. 4). The actuator 61 includes a cavity 62 formed therein. A second of the control ferrules 60 includes a bar 68 engaged into and secured to the actuator 61 of the first control ferrule 60 so as to solidly secure the control ferrules 60 together, such that the control ferrules 60 may rotate in concert with each other. The control ferrules 60 each includes a spring-biased projection 63 for engaging with either of the depressions 53 of the plates 50 and for positioning the control ferrules 60 to the plates 50 and thus to the block 30 and to the head 201. The control ferrules 60 each includes an orifice 66 for rotatably receiving the driving stems 41, 42 respectively. The holes 58 of the plates 50 and the orifices 66 of the control ferrules 60 include a size slightly smaller than that of the gear 40 for rotatably retaining the gear 40 in place and for preventing the gear 40 from being disengaged from the block 30 and the head 201.

It is to be noted that the control ferrules 60 may include only one spring-biased projection 63 which is good enough to position the control ferrules 60 to the plate 50 and the block 30. Only one of the control ferrules 60 is good enough to drive the pawls 33. Without the plates 50, the block 30 may include three depressions for engaging with the spring-biased projection 63 and for positioning the control ferrules 60 to the block 30. The actuator 61 may thus be extended between the pawls 33 without being extended through the notches 52 of the plates 50. Furthermore, the head 201 itself may include the opening 31 and the slot 32 formed therein for receiving the gear 40 and the pawls 33 respectively. Or, alternatively, the block 30 may be taken as an integral part of the head 201 after the block 30 is solidly secured in the head 201 such that the opening 31 and the slot 32 are formed in the head 201 relatively. The driving stems 41, 42 are extended through the plates 50 and the control ferrules 60 respectively for engaging with and driving sockets, fasteners or tool extensions of different sizes.

In operation, as shown in FIGS. 4–6, the pawls 33 may both be biased to engage with the gear 40 when the actuator 61 is located between the pawls 33 and is not forced against the pawls 33. As shown in FIGS. 5 and 6, when the actuator 61 is rotated by either of the control ferrules 60, one of the pawls 33 may be disengaged from the gear 40 such that the gear 40 is allowed to be driven unidirectionally by the head 201 and the handle 20. The active direction of the gear 40 may thus be selectively determined and controlled by the rotation of the control ferrules 60 and by the actuation of the pawls 33.

Accordingly, the ratchet wrench in accordance with the present invention includes two driving stems of different sizes for driving sockets, fasteners or tool extensions of different sizes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A rachet wrench comprising:

a handle including a first end having a head formed thereon, a gear rotatably received in said head and including an upper portion having a first driving stem extended upward therefrom and including a lower portion having a second driving stem extended downward therefrom, a pair of pawls slidably received in said head for engaging with said gear, and means for selectively actuating said pawls to engage with said gear and to control an active direction of said gear and said driving stems, said head including a chamber formed therein and including a block received in said chamber of said head, said block including an opening for rotatably receiving said gear and including a slot tangent to said opening for slidably receiving said pawls.

2. The ratchet wrench according to claim 1, wherein said driving stems include different sizes for engaging with and for driving sockets, fasteners and tool extensions of different sizes.

3. The ratchet wrench according to claim 1, wherein said selectively actuating means includes a spring-biasing means for biasing said pawls to engage with said gear.

4. The ratchet wrench according to claim 1, wherein said selectively actuating means includes a first control ferrule rotatably secured to said head, said first control ferrule includes an actuator engaged into said slot of said block for actuating said pawls respectively when said actuator is rotated by said first control ferrule.

5. The ratchet wrench according to claim 4 further comprising means for positioning said first control ferrule to said head.

6. The ratchet wrench according to claim 5, wherein said positioning means includes a plate secured to said block and having three depressions formed therein, said first control ferrule includes a spring-biased projection for selectively engaging with said depressions and for positioning said first control ferrule to said head.

7. The ratchet wrench according to claim 4, wherein said first control ferrule includes a cavity formed therein, said selectively actuating means further includes a second control ferrule rotatably secured to said head and having a bar engaged into said cavity and secured to said first control ferrule.

* * * * *